US009087497B1

(12) United States Patent
Krol et al.

(10) Patent No.: US 9,087,497 B1
(45) Date of Patent: Jul. 21, 2015

(54) ADJUSTABLE CAJÓN INSTRUMENT

(71) Applicant: DRUM WORKSHOP, INC., Oxnard, CA (US)

(72) Inventors: Andrzej Krol, Wayne, NJ (US); Victor Filonovich, Clifton, NJ (US); Thomas M. Schwarz, Roselle Park, NJ (US); Sergio Bonsignore, Ridgewood, NY (US)

(73) Assignee: KMC Music, Inc., Bloomfield, CT (US)

( * ) Notice: Subject to any disclaimer, the term of this patent is extended or adjusted under 35 U.S.C. 154(b) by 0 days.

(21) Appl. No.: 14/024,485

(22) Filed: Sep. 11, 2013

(51) Int. Cl.
*G10D 13/02* (2006.01)

(52) U.S. Cl.
CPC ..... *G10D 13/021* (2013.01); *G10D 13/02* (2013.01)

(58) Field of Classification Search
CPC ..... G10D 13/02; G10D 13/021
See application file for complete search history.

(56) References Cited

U.S. PATENT DOCUMENTS

| | | | | | |
|---|---|---|---|---|---|
| 423,060 | A * | 3/1890 | Legault | 84/411 R |
| 478,611 | A * | 7/1892 | Knittel | 84/416 |
| D100,734 | S * | 8/1936 | Lira | D17/22 |
| 4,026,185 | A * | 5/1977 | Migirian | 84/411 R |
| D267,014 | S * | 11/1982 | Migirian | D17/22 |
| D296,447 | S * | 6/1988 | Jowitt | D17/22 |
| 5,385,075 | A * | 1/1995 | Carnes et al. | 84/411 R |
| 7,365,258 | B1 * | 4/2008 | Lombardi | 84/422.1 |
| 7,485,790 | B2 * | 2/2009 | Payerl | 84/411 R |
| 7,488,882 | B2 * | 2/2009 | Curet Troche | 84/411 R |
| 7,601,901 | B2 * | 10/2009 | Payerl | 84/411 R |
| 7,692,083 | B2 * | 4/2010 | Aspland | 84/415 |
| 7,816,596 | B2 * | 10/2010 | Bottger | 84/411 R |
| 8,008,560 | B2 | 8/2011 | Wise et al. | |
| 8,115,088 | B2 * | 2/2012 | Herrera | 84/411 R |
| 8,263,848 | B2 * | 9/2012 | Aspland | 84/415 |
| 8,481,834 | B2 * | 7/2013 | Eduardo | 84/411 R |
| 8,487,170 | B2 * | 7/2013 | Klein | 84/411 R |
| 8,735,704 | B2 * | 5/2014 | Buchner | 84/411 R |
| 2008/0034944 | A1 | 2/2008 | Aspland | |
| 2008/0110321 | A1 * | 5/2008 | Wening | 84/421 |
| 2012/0073420 | A1 * | 3/2012 | Schmader | 84/415 |

(Continued)

FOREIGN PATENT DOCUMENTS

| | | | |
|---|---|---|---|
| CA | 2681889 | A1 | 4/2011 |
| ES | 1073064 | U | 1/2011 |
| JP | 2011008040 | A | 1/2011 |
| JP | 2012022103 | A1 | 2/2012 |
| KR | 100828662 | B1 | 5/2008 |

OTHER PUBLICATIONS

Stewart, Dale, How to make a cajon w/snare, Dec. 15, 2009, viewed by the examiner at http://www.stagedive-records.com/cajonhomemade.html on Aug. 5, 2014 4:20:24 PM.*

(Continued)

*Primary Examiner* — Robert W Horn
(74) *Attorney, Agent, or Firm* — Hudnell Law Group P.C.

(57) ABSTRACT

Tunable cajón devices, including tuning and adjustment during a performance, are disclosed. In an aspect, the present disclosure provides a tunable cajón device wherein internal strings or cords under tension may be tuned via the manual manipulation of tuners accessible via a top surface of the cajón. As such, a cajón player may view tuner position and adjust the tuner from the traditional playing position. Adjustments (i.e., tuning of internal strings) may be done before, during, or after a performance.

20 Claims, 1 Drawing Sheet

(56) References Cited

U.S. PATENT DOCUMENTS

| | | | | |
|---|---|---|---|---|
| 2013/0269502 | A1* | 10/2013 | Boulet | 84/421 |
| 2014/0000436 | A1* | 1/2014 | Klein | 84/415 |

OTHER PUBLICATIONS

Zdeněk Martínek, Jak si vylepšit cajón z Iberiky, Dec. 21, 2008, viewed by the examiner at http://www.flamenco.cz/?id=cl/a036_vylepseni_cajonu, Aug. 5, 2014 4:11:25 PM.*

Alex Slifer, Building a Cajon: A First Foray into Acoustic Instrument Building, Physics 401, Spring 2012, http://courses.physics.illinois.edu/phys406/Student_Projects/Spring12/Alex_Slifer_P406_Project_Report_Sp12.pdf, filed at USPTO Mar. 25, 2014.

http://www.cajondg.com/en/products/tecspec.html, filed at USPTO Mar. 25, 2014.

How to Adjust the Top Corners of a Cajon for Slap / Crackle Effect, http://blog.x8drums.com/2009/07/how-to-adjust-top-corners-of-cajonfor.html, (c) 2013 (p. 5)filed at USPTO Mar. 25, 2014.

* cited by examiner

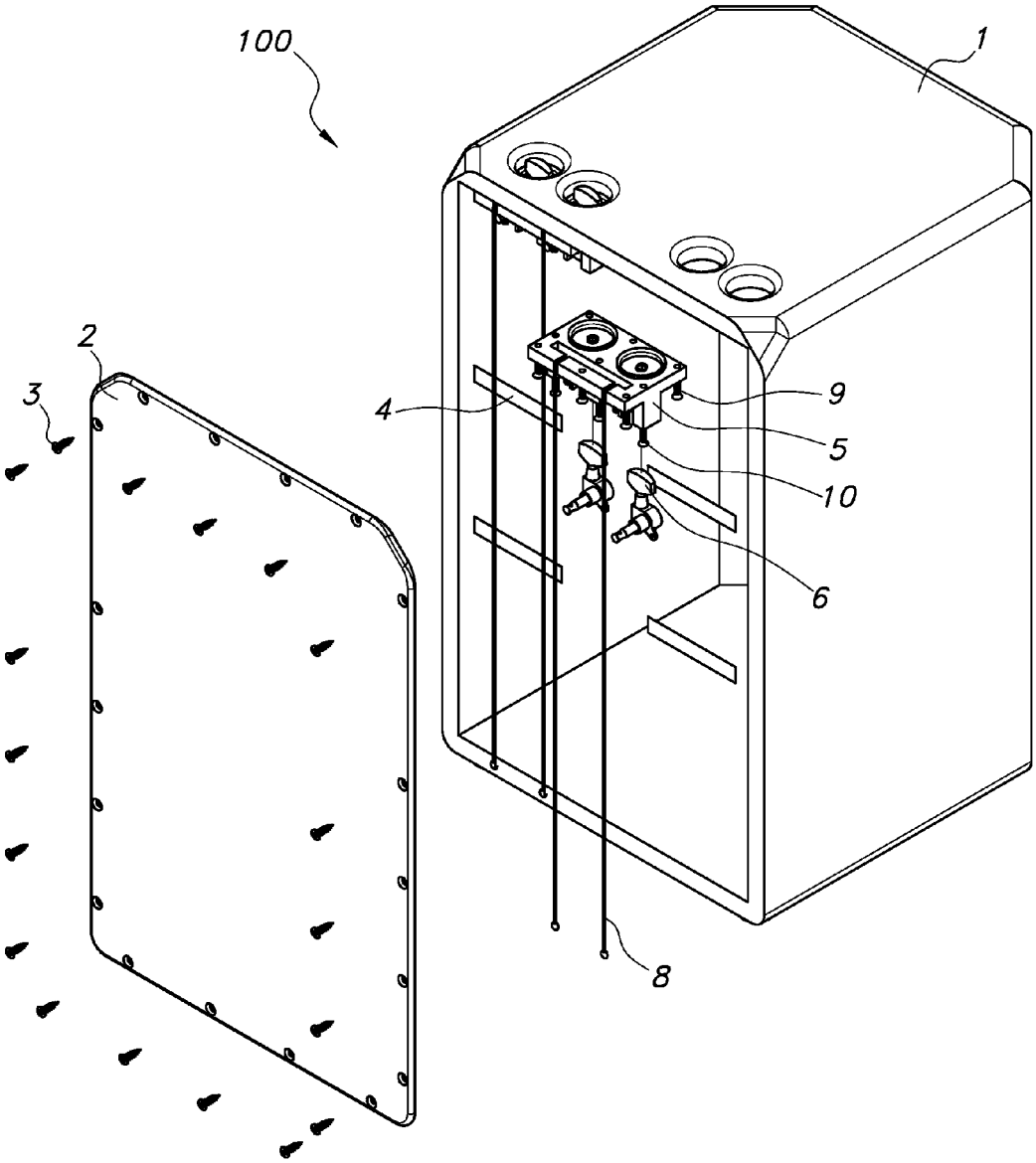
100
1
2
3
4
9
5
10
6
8

ADJUSTABLE CAJÓN INSTRUMENT

FIELD OF THE DISCLOSURE

The present disclosure generally relates to musical instruments and more particularly to systems, methods and apparatuses for facilitating the tuning of percussion instruments such as a cajón.

BACKGROUND

The statements in this section merely provide background information related to the present disclosure and may not constitute prior art.

A wide variety of percussion musical instruments have been developed in used in virtually every instrument-accompanied musical genre. One type of percussion instrument, the box-shaped cajón, originated in Peru and first achieved widespread popularity in the 1850s. In fact, the cajón has been the most widely used Afro-Perusian musical instrument since the 19th century. The origins of the instrument are subject to debate, however the cajón was most likely developed by slave musicians in the Spanish colonial Americas. It is believed that these musicians modified crates, dresser drawers and other boxes into musical instruments similar to the Angola and the Antilles instruments of west and central Africa. By disguising these instruments as common crates, the slaves were able to avoid 19th century Spanish colonial bans on possession of music and music-related equipment by slaves.

Today, the cajón, also known as a drum kit in a box, cajón box, or Cuban box drum, is an integral part of Peruvian and Cuban music. Cajóns often accompany acoustic guitars in modern, western contemporary music. The Cajón is also becoming popular in styles such as blues, pop, rock, funk, fusion, and jazz.

Cajóns may be constructed in a variety of sizes. Typically, a cajón comprises a wooden box. Five of the sides are constructed of half to three-quarter inch thick wood. A thinner sheet of wood (e.g., plywood) is fastened on as the sixth side and acts as the striking surface or head of the drum. This striking surface is often called the tapa. The side opposite the tapa may comprise one or more sound hole openings. Alternatively, the sound hole may be positioned on the side, bottom, or top of the cajón.

Cajóns may additionally comprise one or more cords, guitar strings, rattles, or drum snares pressed against the inner surface of the tapa in order to alter the sound profile of the cajón. Such additional elements may add a buzz-like effect or tone to the cajón. The addition of guitar strings may expand the sound profile of the cajón by adding one or more frequencies to the sounds produced by the cajón. Such guitar strings must be tuned in order to produce the desired sound.

A cajón is played by tapping, slapping, and striking the tapa with the hands, feet and, in some cases, mallets. Typically, the top and bottom edges of the tapa may be left unattached (or loosely connected) and may be slapped against the frame of the box. A cajón player typically sits astride the box and strikes the tapa located between their knees. The cajón produces markedly different sounds depending on the location the tapa is struck. This wide variety contributes to the cajón's popularity. Further expanding the variety of sounds a cajón may produce is needed.

Given the foregoing, systems, methods, and apparatuses are needed that allow for tuning of a guitar-string equipped cajón, including during a performance.

SUMMARY

This Summary is provided to introduce a selection of concepts. These concepts are further described below in the Detailed Description section. This Summary is not intended to identify key features or essential features of this disclosure's subject matter, nor is this Summary intended as an aid in determining the scope of the disclosed subject matter.

Aspects of the present disclosure meet the above-identified needs by providing systems, methods, and apparatuses that allow for cajón to be tuned, including guitar string tuning and adjustment during a performance. In one aspect, the present disclosure provides a tunable cajón device wherein internal strings or cords under tension may be tuned via the manual manipulation of tuners (e.g., a Grover ROTOMATIC® guitar tuner available from Grover Musical Products, Inc. of Cleveland, Ohio) accessible via a top surface of the cajón. As such, a cajón player may view tuner position and adjust the tuner from the traditional playing position. Adjustments (i.e., tuning of internal strings) may be done before, during, or after a performance.

Further features and advantages of the present disclosure, as well as the structure and operation of various aspects of the present disclosure, are described in detail below with reference to the accompanying drawings.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

FIG. 1 is an exploded perspective view of a tunable cajón device, according to an aspect of the present disclosure.

DETAILED DESCRIPTION

The present disclosure is directed to systems, methods, and apparatuses that allow for cajón to be tuned, including guitar string tuning and adjustment during a performance. In one aspect, the present disclosure provides a tunable cajón device wherein internal strings or cords under tension may be tuned via the manual manipulation of tensioners (e.g., a Grover ROTOMATIC® guitar tuner available from Grover Musical Products, Inc. of Cleveland, Ohio) accessible via a top surface of the cajón. As such, a cajón player may view tuner position and adjust the tuner from the traditional playing position. Adjustments (i.e., tuning of internal strings) may be done before, during, or after a performance.

Referring to FIG. 1, an exploded perspective view of a tunable cajón device 100, according to an aspect of the present disclosure, is shown.

Device 100 comprises a frame 1. In an aspect, frame 1 is a five-sized rectangular structure configured as an open-sided box. Frame 1 is configured to support the weight of a cajón player sitting upon a top surface of frame 1. Frame 1 may be constructed of a rigid material, such as wood.

The top portion of frame 1 comprises one or more tuner openings. Each tuner opening is configured to provide access to one or more tuners 6 (described in detail below). In an aspect, frame 1 comprises four circular tuner openings positioned near the front, open face of frame 1 such that the cajón player may access the openings while playing device 100. The tuner openings may be between one and ten centimeters from the front of cajón device 100. In another aspect, the tuner opening is a rectangular opening providing access to multiple tuners 6.

One or more sides of frame 1 may further comprise one or more sound hole openings configured to assist in the production of sounds by device 100.

Device 100 further comprises a tapa 2. Tapa 2 is the striking surface of device 100. Tapa 2 is configured to be struck, tapped, slapped, or otherwise impacted (directly or via another apparatus or tool) by the cajón device 100 player. In an aspect, tapa 2 is constructed of a thin piece of wood. In another aspect, tapa 2 may constructed of a thin, flexible, durable material of natural or synthetic origin.

Tapa 2 is secured to the open side of frame 1 via one or more tapa fasteners 3 (labelled, for clarity, only as tapa fastener 3 in FIG. 1). Tapa fastener 3 may be a nail, a screw, adhesive, or the like. A plurality of tapa fasteners 3 may be evenly spaced around the perimeter of tapa 2. In an aspect, tapa fasteners 3 are spaced in order to allow a top portion of tapa 2 to move when struck by the cajón player.

Device 100 further comprises one or more strings 8 (labelled, for clarity, only as string 8 in FIG. 1). String 8 comprises a first string portion, a string body, and second string portion. String 8 is under tension and capable of producing sounds when tapa 2 is struck. String 8 may be a guitar string, violin string, cable or the like. String 8 may be constructed of natural or synthetic materials.

At the first string portion, string 8 is anchored to a portion of frame 1 separated from the tuner openings and positioned adjacent to tapa 2. String 8 may be permanently or removably anchored to frame 1. In an aspect, string 8 is anchored to a bottom portion of frame 1 adjacent to tapa 2 such that string 8 contacts tapa 2.

At the second string portion, string is connected to tuner 6. Tuner 6 may be a device capable of adjusting the tension contained in an attached string 8. Tuner 6 may be manipulated by an individual or another device (e.g., an electric motor) in order to adjust the tension in the attached string 8. In an aspect, tuner 6 is a guitar tuner. In another aspect, tuner 6 is a tension screw. As will be appreciated by those having skill in the relevant arts, tuner 6 may comprise other devices apart from those mentioned above.

One or more string retainers 4 may be positioned to maintain contact between tapa 2 and string 8. In an aspect, string retainer 4 is a removable piece of tape retaining string 8 at the string body.

Tuner 6 is attached to frame 1 via post 5. Post 5 is a mounting bracket configured to attach one or more tuners 6 to frame 1 and position tuner 6 within a tuner opening so that a user (e.g., a cajón player) may manipulate tuner 6. In an aspect, tuner 6 is attached to post 5 via tuner fastener 10. Post 5 may be attached to an underside portion of the top side of frame 1 via one or more post fasteners 9.

While various aspects of the present disclosure have been described above, it should be understood that they have been presented by way of example and not limitation. It will be apparent to persons skilled in the relevant art(s) that various changes in form and detail can be made therein without departing from the spirit and scope of the present disclosure. Thus, the present disclosure should not be limited by any of the above described exemplary aspects, but should be defined only in accordance with the following claims and their equivalents.

In addition, it should be understood that the figures in the attachments, which highlight the structure, methodology, functionality and advantages of the present disclosure, are presented for example purposes only. The present disclosure is sufficiently flexible and configurable, such that it may be implemented in ways other than that shown in the accompanying figures (e.g., implementations embodied as percussion instruments other than those mentioned herein and having different frame shapes than disclosed in FIG. 1). As will be appreciated by those skilled in the relevant art(s) after reading the description herein, certain features from different aspects of the systems, methods and apparatuses of the present disclosure may be combined to form yet new aspects of the present disclosure.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

What is claimed is:

1. A tunable hand percussion device, comprising:
- a frame having an open front portion, configured for producing sounds, comprising:
  - a first side wall portion;
  - a second wall portion;
  - a rear wall portion;
  - a bottom wall portion; and
  - a top wall portion comprising at least one tuner opening;
- a tapa attached to the frame at the open front portion via at least one tapa fastener, configured as a planar surface to be struck by a user;
- a string tuner; and
- a post attached to the top wall portion, retaining the string tuner in a position accessible via the at least one tuner opening.

2. The hand percussion device of claim 1, further comprising:
- a string, comprising:
  - a first string portion, anchored to the frame at the bottom wall portion;
  - a string body; and
  - a second string portion connected to the string tuner for manipulation of a string tension;
- wherein the string is under tension; and
- wherein the string body is positioned adjacent to the tapa.

3. The hand percussion device of claim 2, wherein the first string portion is removably anchored to the bottom wall portion.

4. The hand percussion device of claim 2, wherein the second string portion is removably connected to the string tuner.

5. The hand percussion device of claim 2, wherein the string body is positioned in parallel with a vertical axis of the tapa.

6. The hand percussion device of claim 2, wherein the string body contacts the tapa.

7. The hand percussion device of claim 2, further comprising a string retainer connected to the tapa, configured to maintain contact between the string and the tapa.

8. The hand percussion device of claim 7, wherein the string retainer is a piece of adhesive tape.

9. The hand percussion device of claim 1, wherein the string tuner is a guitar tuner.

10. The hand percussion device of claim 9, wherein the guitar tuner comprises a rotatable adjustment member, the adjustment member being positioned within the at least one tuner opening.

11. The hand percussion device of claim 1, the top wall portion comprising a top wall front edge interfacing with the tapa wherein the at least one tuner opening is proximal to the top wall front edge portion.

12. The hand percussion device of claim 11, wherein the at least one tuner opening is between one centimeter and ten centimeters away from the top wall front edge portion.

13. The hand percussion device of claim 1, wherein the post is configured to retain the string tuner and at least one additional string tuner.

14. The hand percussion device of claim 13, further comprising:

at least one additional string tuner opening positioned to provide access to the at least one additional string tuner.

15. The hand percussion device of claim 14, further comprising:

at least one additional string comprising:

a first at least one additional string portion, anchored to the frame at the bottom wall portion;

an at least one additional string body; and a second at least one additional string portion connected to the at least one additional string tuner for manipulation of an additional string tension;

wherein the at least one additional string is under tension; and wherein the at least one additional string is positioned adjacent to the tapa.

16. The hand percussion device of claim 1, wherein the frame is rectangular.

17. A tunable hand percussion device, comprising:

a rectangular frame having an open front portion, configured for producing sounds, comprising:

a first side wall portion;

a second wall portion;

a rear wall portion;

a bottom wall portion; and a top wall portion comprising at least one tuner opening;

a tapa attached to the frame at the open front portion via at least one tapa fastener, configured as a planar surface to be struck by a user;

a string tuner;

a post attached to the top wall portion, retaining the string tuner in a position accessible via the at least one tuner opening; and a string, comprising:

a first string portion, anchored to the frame at the bottom wall portion;

a string body; and a second string portion connected to the string tuner;

wherein the string is under tension; and wherein the string body contacts the tapa.

18. A hand percussion device capable of being tuned by a user, comprising:

a rectangular frame having an open front portion, configured for producing sounds, comprising:

a first side wall portion;

a second wall portion;

a rear wall portion;

a bottom wall portion; and a top wall portion comprising at least one tuner opening;

a tapa attached to the frame at the open front portion via at least one tapa fastener, configured as a planar surface to be struck by the user; and a plurality of string assemblies, each comprising:

a string tuner;

a post attached to the top wall portion, retaining the string tuner in a position accessible via the at least one tuner opening; and a string, comprising:

a first string portion, anchored to the frame at the bottom wall portion;

a string body; and a second string portion connected to the string tuner;

wherein each of the string bodies are under tension; and wherein each of the string bodies are positioned adjacent to the tapa.

19. The hand percussion device of claim 18, wherein the at least one tuner opening comprises:

a plurality of cylindrical openings corresponding with the string tuner of each of the plurality of string assemblies.

20. The hand percussion device of claim 18, wherein the plurality of string assemblies each further comprises:

a second string tuner configured to manipulate the tension of an attached string;

a second string, comprising:

a first second string portion, anchored to the frame at the bottom wall portion;

a second string body; and a second second string portion connected to the second string tuner;

wherein the post is further configured to retain the second string tuner in a position accessible via the at least one tuner opening;

wherein each of the second string bodies are under tension; and wherein each of the second string bodies are positioned adjacent to the tapa.

* * * * *